United States Patent [19]

Feller et al.

[11] Patent Number: 4,745,389

[45] Date of Patent: May 17, 1988

[54] PROTECTION SWITCH WITH THERMAL EXCESS-CURRENT RELEASE

[75] Inventors: Willy Feller, Rombach; Peter Hilfiker, Buchs, both of Switzerland

[73] Assignee: Sprecher + Schuh AG, Switzerland

[21] Appl. No.: 32,601

[22] Filed: Apr. 1, 1987

[30] Foreign Application Priority Data

Apr. 7, 1986 [CH] Switzerland ..... 01352/86

[51] Int. Cl.[4] ..... H01H 71/16

[52] U.S. Cl. ..... 337/45; 337/49

[58] Field of Search ..... 337/45–50

[56] References Cited

U.S. PATENT DOCUMENTS 4,475,098 10/1984 Hoffmann et al. ..... 337/49

FOREIGN PATENT DOCUMENTS 890207 9/1953 Fed. Rep. of Germany .
3224012 9/1983 Fed. Rep. of Germany .
1405810 12/1965 France ..... 337/47
2437059 4/1980 France .
2523765 9/1983 France .

*Primary Examiner*—H. Broome
*Attorney, Agent, or Firm*—Hill, Van Santen, Steadman & Simpson

[57] ABSTRACT

A protection switch, or a circuit breaker, includes a bimetallic element provided with a heating winding to form a portion of a structural unit insertable into an upper housing part, said structural unit further including a carrier connected to the bimetallic unit and having a connecting terminal extending from the carrier. The structural unit also including a terminal element connected to the heating winding and having an arc runner continuation, as well as carrying a contact piece of the switch contact. Continuations are provided for positioning the structural unit in a housing, the continuations engaging into guide grooves rigidly provided in the housing. The terminal element, in the region of the contact piece, is pressed against the housing stop and the carrier includes a fork-like free end embracing a catch rib of the housing. The bimetallic element is correctly positioned upon insertion of the structural unit into the housing so that readjustment is not necessary.

15 Claims, 1 Drawing Sheet

PROTECTION SWITCH WITH THERMAL EXCESS-CURRENT RELEASE

BACKGROUND OF THE INVENTION

1. Field of the Invention

The present invention is related generally to a protection switch, or circuit breaker, with a thermal excesscurrent release including at least one bimetallic element.

2. Description of the Related Art

In multi-phase thermal release protection switches, bimetallic elements are each allocated to a respective phase. A free end of each of the bimetallic elements acts on a shared actuation element, which is usually in the form of a slide member. It must be assured by suitable measures that all of the bimetallic elements exert the same force on the actuation element for identical heating. Given a defined ambient temperature and no current flow through the bimetallic elements, the outwardly bending ends of all of the bimetallic elements must be in the same position relative to the actuation element.

To achieve this condition and thereby avoid having to adjust the bimetallic elements in the switch housing after assembly of the protection switch, it has been proposed to form a seating surface on carriers which are provided with the bimetallic elements before insertion into the housing. The seating surface for each of the bimetallic elements proceeds at a right angle relative to a bending direction of the bimetallic elements and at a predetermined identical distance from the deflection ends of the bimetallic elements. A seating surface is disclosed in German Published Application No. 32 24 012.

Cooperating surfaces are formed in the housing, all lying in a common plane. The carriers are secured to the housing with their seating surfaces lying opposite the cooperating surfaces of the housing. It is thus assured that, after complete assembly of the bimetallic elements, the bending ends necessarily assume a position aligned to one another. In this known solution, subsequent adjustment is eliminated, but the manufacturing of the seating surface incurs certain costs.

In German Patent No. 890,207, a protection switch includes a bimetallic element secured to a carrier to form a unit with the bimetallic element. The unit is inserted into a housing part during assembly. The carrier includes arms lying opposite one another and in pairs, which are bent out in a spring-elastic fashion in the bend-out direction of the bimetallic element. When the structural unit formed by the carrier and the bimetallic element is introduced, the arms are resiliently placed against the sidewalls of the housing part so that the unit is held in a defined position. Since the positioning of the structural unit occurs only on the basis of a clamping force, it cannot be assured that the bending end of the bimetallic element assumes a precisely defined position. Thus, additional means must also be provided in order to be able to precisely adjust the bimetallic element after it has been introduced into the housing.

SUMMARY OF THE INVENTION

An object of the present invention is to provide a compact protection switch which is simple to assemble and which eliminates any requirements for adjusting the thermal excess-current release element after integration of the bimetallic elements into a housing.

This and other objects of the invention are achieved by a protection switch, or circuit breaker, having a centering means including guides in the housing extending in an insertion direction of a carrier and bimetallic element unit. The guides define the position of the carrier and bimetallic element unit.

Due to the guides formed in the housing, the carriers, as well as the bimetallic elements secured thereto, are brought into a precisely defined position upon insertion of the carriers into the housing. After integration, thus, the bimetallic elements assume the proper positions so that further adjustment is eliminated. The prerequisite for this, however, is that the position of the bimetallic elements relative to the carriers be the same for all bimetallic elements at the same temperature. This is relatively easily achieved at little expense when fastening the bimetallic elements to their particular carriers. Thereafter, a positionally correct assembly of the carriers and the bimetallic elements is accomplished in a simple way, by inserting the structural units formed by the carriers and bimetallic elements into the housing. In preferred exemplary embodiments, the guides include guide grooves formed in the housing and cooperating with projections extending from the carrier.

The centering means also includes latch elements on the housing and on the carrier which cooperate with one another. The latch elements of a preferred embodiment is in the form of catch tab, or rib, extending between two tines provided on the carrier; one tine on the carrier being deformable to securely engage the tab or rib.

A connecting terminal is preferably provided on the carrier, the connecting terminal having a threaded bore for accepting a fixing screw and being secured against rotation by a guide in the housing. A terminal element of a preferred embodiment includes a contact piece of the contact switch which is connected to a heating winding having one end connected to the bimetallic element. The terminal element is guided in rigid guides within the housing which extend in an insertion direction of the carrier. The terminal element guides of a preferred embodiment are guide grooves into which continuations project from the terminal element. A detent may also be provided against which the terminal element is pressed.

Both the manufacture and the assembly of the present device are simplified when the carriers are provided with a connecting terminal projecting therefrom and when the terminal elements carry a contact piece of the switch contact, the terminal element being connected to one of the heating winding which has its other end connected to the bimetallic element.

DESCRIPTION OF THE PREFERRED EMBODIMENTS

Figures 1, 2, 3, 4:
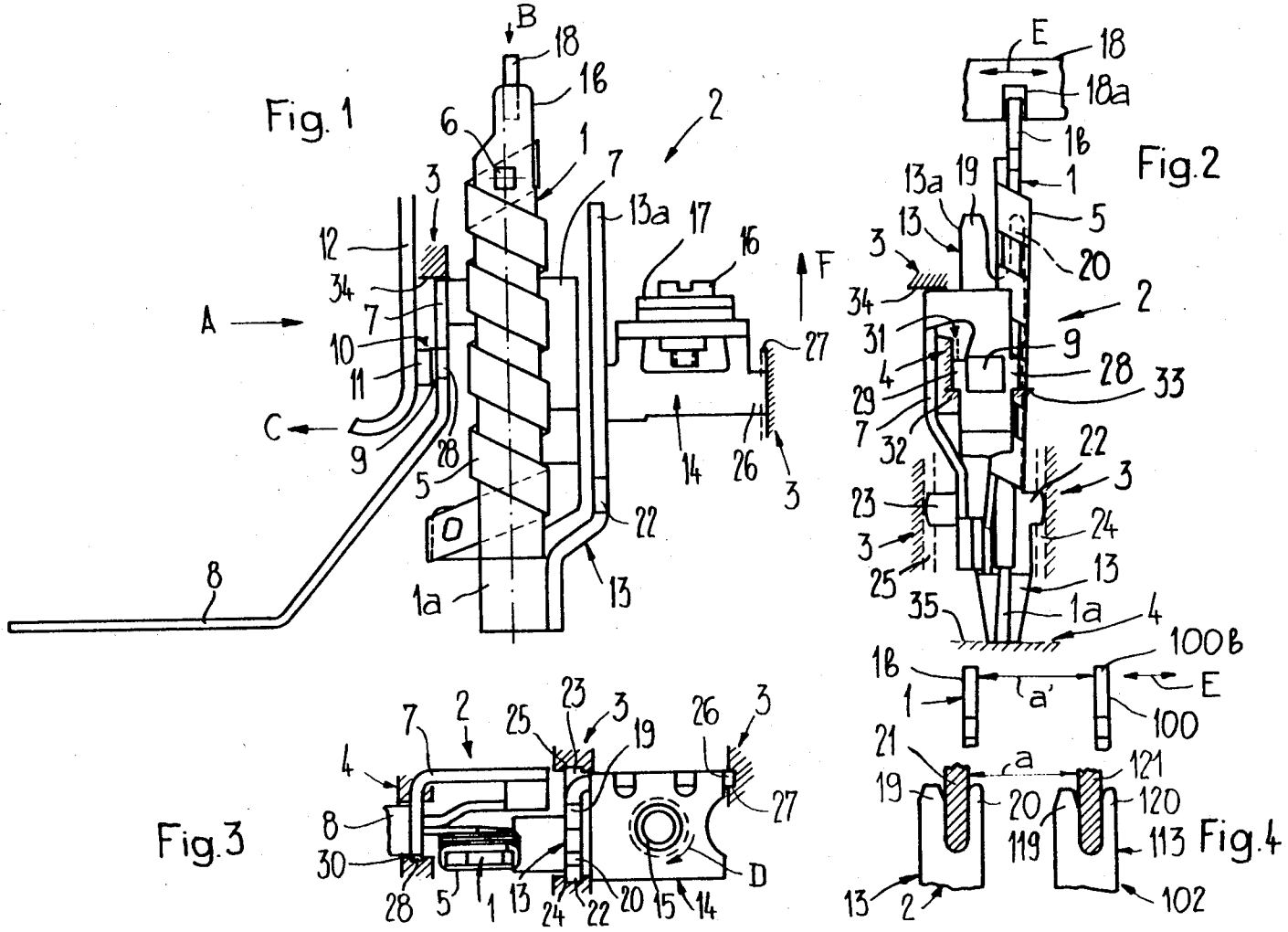
FIG. 1 is a side elevational view of a structural unit according to the principles of the present invention introduced into a housing and formed of a carrier and a bimetallic element secured thereto.
FIG. 2 is a side elevational view in the direction of arrow A of FIG. 1 showing the structural unit of the invention.
FIG. 3 is a plan view in the direction of arrow B of FIG. 1 showing a further view of the structural unit.
FIG. 4 is a schematic illustration of the carriers and bimetallic elements of two inventive structural units disposed side-by-side according to the principles of the present invention.

In FIGS. 1, 2, and 3 are shown various views of a structural unit 2 allocated to a single phase of a multi-phase protection switch, or circuit breaker, having a thermal excess-current release. Additional structural units formed in the same fashion as the structural unit 2 shown in FIGS. 1 through 3 are allocated to the other phases and are not shown in FIGS. 1 through 3. All of the structural units 2 for the multi-phase switch are accommodated side-by-side in a housing in a known way, the housing being shown in the Figures only where it cooperates with the illustrated structural unit 2. In the exemplary embodiment, the housing includes an upper housing part 3 and a cover part 4 fastenable thereto, the upper housing part 3 and the cover part 4 being merely suggested in the Figures.

Still referring to FIGS. 1 through 3, a bimetallic element 1 of the structural unit 2 is provided wrapped with a heating winding 5 which has one end connected to the bimetallic element 1 at a fastening point 6 adjacent a free end 16. The heating winding 5 carries current conducted by the switch and heats the bimetallic element according to the current flow therethrough. A terminal element 7 is connected to the other end of the heating winding 5, the terminal element 7 being formed in a single piece with an arc runner, or fin, 8. The terminal element 7 includes a contact piece 9 which forms a switch contact 10 with a movable contact piece 11. The movable contact piece 11 is secured to a movable carrying arm 12 shown schematically in FIG. 1. The movable contact arm 12 is movable in the direction of an arrow C to open the switch contact 10 and, thus, open one phase of the multi-phase circuit breaker.

The bimetallic element 1 is of an overall oblong configuration with an end 1*a* rigidly connected to a metallic carrier 13. The metallic carrier 13 includes a projecting connecting terminal 14 which is formed in a single piece with the carrier 13. The connecting terminal 14 includes a threaded bore 15 as shown in FIG. 3 into which a fixing screw 16 as shown in FIG. 1 is fastened. From FIG. 1, a clamp lamina 17 is also provided, pressed against the connecting terminal 14 when the fixing screw 16 is turned in the direction of arrow D as shown in FIG. 3.

The free end 1*b* of the bimetallic element 1 bends in the direction of an arrow E (shown in FIG. 2) when heated. The free end 1*b* of the bimetallic element 1 engages a groove 18*a* of a slide 18 which is slidably displaceable in the housing in the bending direction E of the bimetallic element 1. Movement of the slide 18 actuates a release mechanism (not shown).

In FIG. 2, the carrier 13 includes a fork-like free end having first and second tines 19 and 20 extending spaced from one another. When the structural unit 2 is inserted into its final position in the upper housing part 3, a latch projection, or rib, 21 shown in FIG. 4 and forming a portion of the upper housing part 3, engages between the two tines 19 and 20. The second tine 20 is plastically deformable to compensate for manufacturing variations between the latch rib 21 and the tines 19 and 20. To accomplish this, the second tine 20 is narrower than the first tine 19 so that it bends somewhat upon engaging the rib 21. The tines 19 and 20, thus, embrace the latch rib 21 that is rigidly connected to the housing 3. The carrier 13 and, thus, the entire structural unit 2, first, is held in the upper housing part 3 and, second, is also centered and held in a predetermined position.

Projections 22 and 23 project from the carrier 13 to further contribute to the centering and positioning of the structural unit 2. The projections 22 and 23 extend into grooves 24 and 25 which are formed in the upper housing part 3. The grooves 24 and 25 extend along an insertion direction F for the structural unit 2 to accommodate the projections 22 and 23 as they move therealong during insertion of the structural unit 2.

As a result of the projections 22 and 23 extending from one end of the carrier 13 and engaging into the grooves 24 and 25, which are rigidly applied in the housing, the carrier 13, together with the bimetallic element 1, is guided upon insertion of the structural unit 2. Secondly, the carrier 13 is held in the position defined by the guide grooves 24 and 25. As a result of the tines 19 and 20 formed in the end of the carrier 13 and accepting the rigidly positioned housing latch rib 21 therebetween, the carrier 13 is further positioned with respect to the latch rib 21 as set forth above.

During the course of insertion of the structural unit 2 into the upper housing part 3 in the direction of the arrow F, the carrier 13 is necessarily brought into a predetermined position as defined by the guide grooves 24 and 25 and the latch rib 21. At a given temperature, this means that the bending free end 1*b* of the bimetallic element 1 is also at a precisely defined position relative to the slide 18 and relative to the bimetallic elements of the other phases, as well. This precise alignment is illustrated in FIG. 4, in which the carrier 13 and another carrier 113 of the structural unit 2 and a corresponding second structural unit 102 lie side-by-side. The end 1*b* and an end 100*b* of the corresponding bimetallic elements 1 and 100 are shown in a purely schematic fashion. The tines 19 and 20 and, respectively, 119 and 120, embrace the respective latch ribs 21 and 121 which are rigidly secured in the housing and are arranged at a predetermined fixed distance a from one another. Since, as already mentioned, the bimetallic elements 1 and 100 have the same position relative to the corresponding carriers 13 and 113, the deflectable ends 1*b* and 100*b* of the bimetallic elements 1 and 100 are provided at a defined spacing given identical temperatures. This defined spacing is determined by the spacing a of the catch ribs 21 and 121.

Referring again to FIGS. 1 through 3, the connecting terminal 14 is also provided with a projection 26 extending into and engaging a groove 27 formed in the upper housing part 3. The groove 27 extends along the insertion direction F of the structural unit 2 so that the projection 20 moves therealong during assembly. As a result of the projection 26 engaging the groove 27, torques which occur when tightening the fixing screw 16 in the direction of the arrow D are intercepted. The carrier 13 connected to the connecting terminal 14 is thereby prevented from being deformed when the fixing screw 16 is tightened to further assure correct alignment of the structural unit 2 and its elements.

The terminal element 7 includes two continuations 28 and 29 projecting away from the region of the contact piece 9. The continuations 28 and 29 engage grooves 30 and 31 in the cover part 4. The grooves 30 and 31, which are shown in corresponding FIGS. 2 and 3, likewise extend in the insertion direction F. As a result of the grooves 30 and 31, the terminal element 7 is positioned, as is the arc runner 8. In particular, the region of the element adjacent the contact piece 9 is accurately positioned.

Shoulders 32 and 33, which are formed in the cover plate 4 engage the projections 28 and 29 and thereby press the terminal element 7 against a stop 34 formed in the upper housing part 3, as shown in FIG. 2. The terminal element 7, together with the arc runner 8, is thus retained between the shoulders 32 and 33 and the stop 34. In other words, the terminal element 7 is fixed in position by the upper housing part 3 and the cover plate 4. That portion of the terminal element 7 which carries the contact piece 9 is, thus, fixed within the housing.

The structural unit 2 is formed by the metallic element 1 combined with the carrier 13, the connecting terminal 14, the terminal element 7, together with the arc runner 8 and the contact piece 9. The structural unit 2 can be assembled in the multi-phase switch in a simple way by insertion into the upper housing part 3. The grooves 23 and 25 in the upper housing part 3 provide guidance and simultaneous positioning of the structural unit 2, while the catch rib 21 contributes to the final positioning. The terminal element 7 is likewise guided and positioned, and in particular, in the region thereof having the contact piece 9, by the grooves 30 and 31 in the cover plate 4. The structural unit 2 is, thus, fixed first by tines 19 and 20 embracing the catch rib 21 and, second, by the clamping of the terminal element 7 between the stop 34 and the shoulders 32 and 33 of the cover plate 4.

With the insertion of the structural unit 2, the position thereof is provided in a constrained fashion so that subsequent adjustment is superfluous. Fixing of the structural unit also ensues in a constrained fashion and without additional worksteps when the cover plate 4 is fastened onto the housing part 3. The region 35 shown in FIG. 2 presses against the end 1*a* of the bimetallic element and against the end of the carrier 13 connected thereto to further retain the structural unit 2 in position.

Although other modifications and changes may be suggested by those skilled in the art, it is the intention of the inventors to embody within the patent warranted hereon all changes and modifications as reasonably and properly come within the scope of their contribution to the art.

We claim as our invention:

1. A protection switch having a thermal excess-current release, comprising:

at least one bimetallic element;

a carrier secured to said bimetallic element to form a unit;

a housing including first and second housing parts, said unit being insertable into said first housing part;

centering means for holding said unit in a defined position in said housing, said centering means coming to bear on said carrier upon insertion of said carrier into said first housing part; said centering means including:

guides in said housing extending in an insertion direction of said carrier and said bimetallic element, said carrier being guided by said guides, said guides defining a position of said carrier together with said bimetallic element in a deflection direction of said bimetallic element.

2. A protection switch as claimed in claim 1, further comprising:

guide grooves provided fixed in said housing; and projections extending from said carrier for engagement into said guide grooves.

3. A protection switch as claimed in claim 1, wherein said centering means includes latch elements collaborating with one another, said latch elements being provided both at said housing and at said carrier.

4. A protection switch as claimed in claim 3, wherein one of said latch elements is a catch rib rigidly mounted with respect to said housing, and another of said latch elements includes two tines provided at said carrier.

5. A protection switch as claimed in claim 4, wherein one of said two tines is deformable.

6. A protection switch as claimed in claim 1, wherein said carrier includes a connecting terminal projecting from said carrier.

7. A protection switch as claimed in claim 6, wherein said connecting terminal is provided with a threaded bore, and further comprising:

a fixing screw secured into said threaded bore, and a guide rigidly applied to said housing to secure said connecting terminal against rotation in a turning direction of said fixing screw.

8. A protection switch as claimed in claim 1, further comprising:

a terminal element carrying a contact piece of a switch contact, and a heating winding having a first end connected to said bimetallic element, said switch contact being connected to said heating winding.

9. A protection switch as claimed in claim 8, further comprising:

rigid housing guides for guiding said terminal element in the region of said contact piece, said guides proceeding in an insertion direction of said carrier.

10. A protection switch as claimed in claim 9, wherein said guides are guide grooves and wherein said terminal element includes projecting continuations to engage into said guide grooves.

11. A protection switch as claimed in claim 9, further comprising:

a detent against which said terminal element is pressed, and locking means rigidly provided on said housing for pressing said terminal element against said detent.

12. A circuit breaker switch structure for use in a multi-phase protection switch housing, comprising:

a thermally responsive bimetallic element having first and second opposite ends;

a movable actuator in said housing for movement by said first end of said bimetallic element;

a carrier affixed to said second end of said bimetallic element, said carrier including a connecting terminal;

first guide means for positioning said carrier in said housing in a defined position, said first guide means providing cooperative contact between said carrier and said housing;

a heating element applied to said bimetallic element for carrying current;

a terminal element connected to said heating element and having a contact piece for said circuit breaker; and second guide means for positioning said terminal element in said housing.

13. A circuit breaker switch structure as claimed in claim 12, wherein said first and second guide means includes projections on said carrier and on said terminal element extending into slots in said housing.

14. A circuit breaker switch structure as claimed in claim 13, wherein said guide means include abutments in said slots for abutting said projections.

15. A circuit breaker switch structure for use in a multi-phase protection switch housing, comprising:

a thermally responsive bimetallic element having first and second opposite ends;

a movable actuator in said housing for movement by said first end of said bimetallic element;

a carrier affixed to said second end of said bimetallic element, said carrier including a connecting terminal;

first guide means for positioning said carrier in said housing in a defined position, said first guide means providing cooperative contact between said carrier and said housing, said first guide means including a slot on said carrier and a projection on said housing extending into said slot.

* * * * *